US005588973A

United States Patent [19]

Blackborow et al.

[11] Patent Number: 5,588,973

[45] Date of Patent: Dec. 31, 1996

[54] FUEL COMPOSITIONS CONTAINING A POLYISOBUTENE SUCCINIMIDE DETERGENT

[75] Inventors: John R. Blackborow, Edinburgh, Scotland; Michael J. Clarke, Burton Pidsea, England

[73] Assignee: BP Chemicals Limited, London, England

[21] Appl. No.: 482,744

[22] Filed: Jun. 7, 1995

Related U.S. Application Data

[63] Continuation of Ser. No. 40,162, Mar. 30, 1993, abandoned.

[30] Foreign Application Priority Data

Apr. 10, 1992 [GB] United Kingdom ..... 9208034

[51] Int. Cl.[6] ..... C10L 1/22

[52] U.S. Cl. ..... 44/347; 44/331

[58] Field of Search ..... 44/331, 347

[56] References Cited

U.S. PATENT DOCUMENTS

| | | | |
|---|---|---|---|
| 3,960,515 | 6/1976 | Honnen | 44/432 |
| 4,098,585 | 7/1978 | Vartanian et al. | 252/51.5 A X |
| 4,605,808 | 8/1986 | Samson | 585/525 |
| 4,832,702 | 5/1989 | Kummer et al. | 44/412 |
| 5,089,028 | 2/1992 | Abramo et al. | 44/347 |
| 5,114,435 | 5/1992 | Abramo et al. | 44/348 |
| 5,122,507 | 5/1992 | Harrison | 252/51.5 A |
| 5,256,165 | 10/1993 | Herbstman et al. | 44/347 |

FOREIGN PATENT DOCUMENTS

| | | |
|---|---|---|
| 0355895 | 2/1990 | European Pat. Off. . |
| 960493 | 6/1964 | United Kingdom . |

*Primary Examiner*—Prince Willis, Jr.
*Assistant Examiner*—Cephia D. Toomer
*Attorney, Agent, or Firm*—Brooks Haidt Haffner & Delahunty

[57] ABSTRACT

A fuel composition which comprises a major amount of a liquid hydrocarbon fuel and, in an amount to provide detergency, a polyisobutene (PIB) succinimide derived from the reaction of a polyisobutene—substituted succinic acylating agent and an amine having at least one reactive hydrogen bonded to an amine nitrogen is characterised in that the polyisobutene—substituted succinic acylating agent is obtained by a thermal route and the polyisobutene substituent is derived from a highly reactive polyisobutene ie having a high proportion of vinylidene groups $—CH_2CMe{=}CH_2$. The PIB-substituted succinic acylating agent is preferably obtained by the thermal reaction of the highly reactive polyisobutene with a succinic acylating agent e.g. maleic anhydride.

14 Claims, No Drawings

FUEL COMPOSITIONS CONTAINING A POLYISOBUTENE SUCCINIMIDE DETERGENT

This application is a continuation of application Ser. No. 08/040,162, filed Mar. 30, 1993, now abandoned.

The present invention relates in general to hydrocarbon fuel compositions and in particular to hydrocarbon fuel compositions containing a polyisobutene succinimide detergent additive.

Hydrocarbon fuels generally contain numerous deposit-forming substances. When used in internal combustion engines, deposits tend to form on and around constricted areas of the engine in contact with the fuel. In diesel engines, deposits tend to accumulate in the fuel injection system, thereby hampering good performance of the engine. In automobile engines deposits can build up on engine intake valves leading to progressive restriction of gaseous fuel mixture flow into the combustion chamber and also to valve sticking.

It is common practice to incorporate a detergent in the fuel composition for the purpose of inhibiting the formation, and facilitating the removal, of engine deposits, thereby improving engine performance. Not all detergents are equally effective in cleaning specific parts of the engine. Thus it is known in the art that good valve inlet port detergents are those based on polyisobutene (PIB) amines. This is taught in a paper presented by T. J. Bond, F. S. Gerry and R. W. Wagner to the International Fuels and Lubricants Meeting and Exposition, Baltimore, Md., Sep. 25–28, 1989, entitled "Intake Valve Deposit Control—A Laboratory Program to Optimise Fuel/Additive Performance". These authors also teach that for valve inlet port cleanliness at comparable dose rates PIB amines are very much better than PIB succinimides, which are well-known as lubricating oil detergents.

PIB succinimides are generally prepared by the reaction of a PIB-substituted succinic acylating agent, typically PIB-substituted succinic anhydride (PIBSA), with an amine having at least one reactive hydrogen bonded to an amine nitrogen, typically a polyethylene polyamine. PIB-substituted succinic acylating agents, as is well-known in the art, can be prepared either by the thermal reaction of a PIB with a succinic acylating agent, eg maleic anhydride, or by reaction of a PIB with a halogen to form an intermediate PIB halide, followed by reaction of the intermediate PIB halide with a succinic acylating agent, eg maleic anhydride, ie by a halogenation route.

In fact because of the excellent performance of PIB amines and the relatively poor performance of PIB succinimides in inlet valve deposit cleanliness screening tests, efforts to investigate the performance of PIB succinimides were not pursued, though the authors did warn that such results should not be considered conclusive. Good results are also reported in the paper for combustion chamber deposit control and port fuel injector cleanliness. No data is provided on manifold cleanliness.

WO-A-90/03359 discloses a copolymer, obtainable by free radical initiated polymerisation, of an unsaturated acidic reactant and a high molecular weight olefin having a sufficient number of carbon atoms such that the resulting copolymer is soluble in lubricating oil and wherein at least 20 percent of the total olefin comprises an alkylvinylidene isomer The copolymers are assigned the formula:

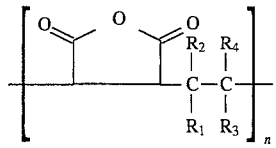

wherein n is 1 or greater, and $R_1$, $R_2$, $R_3$ and $R_4$ are selected from hydrogen, lower alkyl of 1 to 6 carbon atoms and high molecular weight polyalkyl; wherein either $R_1$ and $R_2$ are hydrogen and one of $R_3$ and $R_4$ is lower alkyl and the other is high molecular weight polyalkyl, or $R_3$ and $R_4$ are hydrogen and one of $R_1$ and $R_2$ is lower alkyl and the other is high molecular weight polyalkyl. The copolymer can be converted to a polysuccinimide by reaction with a polyamine. Both the copolymer and the polysuccinimide derived from it can be used as dispersancy and/or detergency additives in fuel compositions. The disclosure specifically differentiates the copolymers from PIBSAs prepared by the thermal process, particularly in the statement:

> "The copolymers of the present invention differ from the PIBSAs prepared by the thermal process in that the thermal process products contain a double bond and a singly substituted succinic anhydride group".

The copolymers contain no double bonds and the succinic anhydride groups are doubly substituted (ie they have two substituents, one of which may be hydrogen) at the 2- and 3- positions, that is:

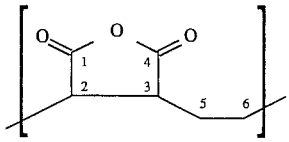

Thus, it is unambiguously acknowledged in WO-A-90/03359 that the copolymers disclosed therein differ from PIBSAs obtained by a thermal route.

Arising from the method of preparation, generally by reaction of a PIB halide, specifically a PIB chloride, with an amine, PIB amines generally contain significant amounts of residual chlorine. This can be a problem insofar as combustion with the fuel of a chlorine-contaminated PIB amine can produce traces of materials known as dioxins (cyclic hydrocarbons containing oxygen and chlorine), which are known to be highly toxic. The problem to be solved by the present invention is therefore twofold: it is to identify a hydrocarbon fuel detergent additive firstly which, in addition to having inlet valve cleansing properties, also has manifold cleansing properties and secondly which, when finally burned with the fuel, has little or no chance of producing by incomplete combustion harmful dioxins. We have solved the problem of the prior art by providing as a hydrocarbon fuel detergent additive a PIB succinimide derived from a PIB-substituted succinic acylating agent obtained by a thermal route in which the PIB substituent is derived from a PIB wherein greater than 50% of the residual olefinic double bonds are of the vinylidene type, ie represented by the formula:

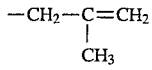

in which PIB is hereinafter to be referred to as a highly reactive PIB. A highly reactive PIB is to be distinguished from a conventional PIB, in which the majority of the olefinic double bonds are internal double bonds, i.e not of the vinylidene type.

Accordingly the present invention provides a fuel composition comprising a major amount of a liquid hydrocarbon fuel and, in an amount to provide detergency, a polyisobutene (PIB) succinimide derived from the reaction of a polyisobutene-substituted succinic acylating agent and an amine having at least one reactive hydrogen bonded to an amine nitrogen characterised in that the polyisobutene-substituted succinic acylating agent is obtained by a thermal route and the polyisobutene substituent is derived from a highly reactive polyisobutene.

For the purpose of the present invention there are used PIB-substituted succinic acylating agents produced by a thermal route, thereby avoiding possible halogen contamination of both the acylating agent and the succinimide obtained therefrom.

Thermal processes for the production of PIB-substituted succinic acylating agents are well known in the art. Representatives of that art may be mentioned, for example, U.S. Pat. No. 3,018,247; U.S. Pat. No. 3,018,250; U.S. Pat. No. 3,018,291; U.S. Pat. No. 3,172,892; U.S. Pat. No. 3,184,474; U.S. Pat. No. 3,185,704; U.S. Pat. No. 3,194,812; U.S. Pat. No. 3,194,814; U.S. Pat. No. 3,202,678; U.S. Pat. No. 3,216,936; U.S. Pat. No. 3,219,666; U.S. Pat. No. 3,272,746; U.S. Pat. No. 3,287,271; U.S. Pat. No. 3,311,558 and U.S. Pat. No. 5,137,978. Typically, the succinic acylating agent and the polybutene are reacted at a temperature greater than 200° C. at elevated pressure and, optionally, in the presence of an inert gas. Subsequent to the reaction unreacted acylating agent is generally removed by suitable means.

Highly reactive PIBs, that is PIBs wherein greater than 50%, preferably greater than 70%, of the residual olefinic double bonds are of the vinylidene type, are commercially available. Any such PIB may be employed in the present invention. A preferred highly reactive PIB is ULTRAVIS-(RTM) manufactured by BP Chemicals Limited. ULTRAVIS(RTM) is a preferred PIB because it is substantially chlorine-free and can therefore lead to chlorine-free succinimides.

The percentage of residual olefinic double bonds in a PIB which are of the vinylidene type may be determined by well-known methods, such as for example Infra-Red Spectroscopy or $C_{13}$ Nuclear Magnetic Resonance or a combination thereof.

The number average molecular weight of the highly reactive PIB may vary over a wide range consistent with solubility of the final PIB succinimide in the fuel. Typically the molecular weight may be in the range from about 500 to about 10,000, preferably from about 700 to about 5,000, more preferably from about 750 to about 3,000.

Suitable succinic acylating agents may be represented by the formula:

$$R—CO—CH{=}CH—CO—R^1 \quad (I)$$

wherein R and $R^1$ are independently —OH, —O-hydrocarbyl or taken together are a single oxygen atom. Thus, there may be used, for example, maleic acid, fumaric acid, maleic anhydride, or mixtures of any two or more of the aforesaid. Other similar compounds which can be used are itaconic acid, itaconic anhydride, citraconic acid, citraconic anhydride or mesaconic acid. Of the aforesaid compounds, maleic anhydride is the most preferred. Thermal reaction of the PIB with maleic anhydride as the succinic acylating agent provides PIB-substituted succinic anhydride (PIBSA) of the formula:

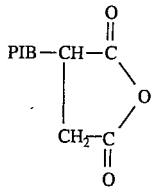

The thermally prepared intermediate PIB-substituted succinic acylating agent, preferably PIBSA, is thereafter reacted with an amine having at least one reactive hydrogen bonded to an amine nitrogen atom to produce the PIB-substituted succinimide for use as a detergent in fuels, particularly for inlet valve and manifold cleansing purposes. The reaction for producing succinimides is well-known in the art, as represented by for example U.S. Pat. No. 2,992,708; U.S. Pat. No. 3,018,291; U.S. Pat. No. 3,024,237; U.S. Pat. No. 3,100,673; U.S. Pat. No. 3,219,666; U.S. Pat. No. 3,172,892 and U.S. Pat. No. 3,272,746. Typically, the amine and the acylating agent are contacted at the appropriate molar ratio at a temperature suitably in the range from 80° to 250° C., preferably from 120° to 180° C., in the presence or absence of a solvent for a period of from 2 to 24 hours. Suitable solvents include for example aliphatic and aromatic hydrocarbons and mixtures thereof. The reaction may be effected in an inert atmosphere, eg nitrogen, if desired. The product may be isolated by conventional methods.

Preferably the amine has at least one reactive primary amine group capable of reacting with the acylating agent to form a succinimide. Examples of such primary amines are n-octylamine, N,N-dimethyl-1,3-propane diamine, N-(3-aminopropyl)piperazine, 1,6-hexane diamine, and the like. More preferably the amine is a polyalkylene polyamine, or a mixture thereof, having the formula:

$$H_2N\ (R—NH)_nH \quad (II)$$

wherein R is a divalent aliphatic hydrocarbon group having 2 to 4 carbon atoms and n is an integer in the range from 1 to 10. More preferably the amine is a polyalkylene polyamine of the formula (II) wherein R is the group $—CH_2CH_2—$ and n has a value of 2 to 6, i.e. a polyethylene polyamine. Examples of suitable polyethylene polyamines include triethylene tetramine and tetraethylene pentamine. Hydroxyalkyl amines, for example ethanolamine, diethanolamine, 2-hydroxypropylamine and N-hydroxy-ethyl ethylenediamines, and the like may also be reacted with the acylating agent if desired.

Surprisingly PIB succinimides wherein the PIB substituent is derived from a highly reactive PIB are much more effective in cleaning valve inlet ports than a PIB succinimide derived from a conventional PIB. Surprisingly, also, both are effective in cleaning engine manifolds. Moreover, it is possible to produce PIB succinimides substantially free of chlorine from highly reactive PIBs, thereby enabling more environmentally friendly fuel compositions to be produced.

As the liquid hydrocarbon fuel there may be used either a hydrocarbon boiling in the gasoline range or a hydrocarbon boiling in the diesel range. Gasolines suitable for use in spark ignition engines, e.g. automobile engines, generally boil in the range from 30° to 230° C. Such gasolines may comprise mixtures of saturated, olefinic and aromatic hydrocarbons. They may be derived from straight-run gasoline, synthetically produced aromatic hydrocarbon mixtures, thermally or catalytically cracked hydrocarbon feedstocks, hydrocracked petroleum fractions or catalytically reformed hydrocarbons. The octane number of the base fuel is not critical and will generally be above 65. In the gasoline, hydrocarbons may be replaced in part by alcohols, ethers, ketones or esters. Alternatively, as the liquid hydrocarbon fuel there may be used any fuel suitable for operating diesel engines, such as those which may be found in road vehicles, ships, and the like. Generally, such a diesel fuel will boil in the range from about 140° C. to about 400° C. (at atmospheric pressure), particularly in the range from about 150° to 390° C., especially from about 175° to 370° C. Such fuels may be obtained directly from crude oil (straight-run) or from a catalytically or thermally cracked product or a hydrotreated product, or from a mixture of the aforesaid. The octane number will typically be in the range from 25 to 60.

The fuel composition contains the PIB succinimide in an amount sufficient to provide detergency, preferably in an inlet valve and manifold cleansing amount. Typically, this may be an amount in the range from 20 to 100 ppm w/w based on the total weight of the composition.

The composition may also contain in addition to the foregoing a hydrocarbyl amine. A preferred hydrocarbyl amine is a PIB polyamine. More preferred is a PIB polyamine wherein the PIB moiety is derived from a highly reactive PIB. The PIB moiety suitably contains sufficient carbon atoms to render the PIB polyamine soluble in the fuel composition. Typically this may be at least 20 carbon atoms and up to 500 carbon atoms, preferably from 30 to 150 carbon atoms. The polyamine moiety may be for example a polyalkylene polyamine of the formula (I) as hereinbefore described. Alternatively, the amine moiety may be hydroxy- or alkoxy-substituted. Thus, the PIB amine may be for example a compound of the formula:

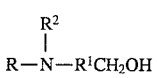

$$R-\overset{\overset{\displaystyle R^2}{|}}{N}-R^1CH_2OH \qquad \text{(II)}$$

wherein R is a PIB moiety having from 20 to 500, preferably from 30 to 150 carbon atoms, preferably a PIB moiety derived from a highly reactive PIB, $R^1$ is an amino-substituted hydrocarbylene group and $R^2$ is a hydrogen atom or an alkyl group containing from 1 to 4 carbon atoms. Hydrocarbyl amines and methods for their preparation are well-known in the art, representative of which may be mentioned, for example, GB-A-1405305; U.S. Pat. No. 3,884,647; U.S. Pat. No. 3,876,704; U.S. Pat. No. 3,869,514; GB-A-1342853; U.S. Pat. No. 3,960,515; GB-A-1419957; U.S. Pat. No. 3,852,258; GB-A-1405652; GB-A-1254338; U.S. Pat. No. 3,438,757; GB-A-1507517 and GB-A-1507379. A preferred hydrocarbyl amine for use in the composition of the invention is one prepared by a method which minimises the halogen content of the hydrocarbyl amine resulting therefrom.

In addition to the foregoing the fuel compositions may contain known additives. The nature of the additives will depend to some extent on the end-use of the fuel composition. Diesel fuel compositions may contain one or more nitrates or nitrites as an octane improver, or copolymers of ethylene and/or vinylesters, e.g. vinylacetate, as a pour point depressant. Gasoline fuel compositions may contain a lead compound as an anti-knock additive and/or an antioxidant, e.g. 2,6-di-tert-butyl phenol, and/or an antiknock compound other than a lead compound. Gasoline fuel compositions may be free of lead and contain octane boosters such as MTBE, t butyl-alcohol, methanol etc.

The PIB succinimide may be added as a blend with one or more other additives. A convenient method for preparing the fuel composition is therefore to prepare a concentrate of the PIB succinimide together with the other additive or additives, if any, and then to add this concentrate to the fuel in the amount required to produce the required final concentration of the additive or additives.

The invention accordingly provides in another aspect thereof a concentrate composition suitable for use in the aforedescribed fuel composition, the composition comprising a PIB succinimide derived from the reaction of a PIB-substituted succinic acylating agent and an amine having at least one reactive hydrogen bonded to an amine nitrogen, a fuel soluble carrier and/or a fuel soluble diluent characterised in that the PIB-substituted succinic acylating agent is obtained by a thermal route and the PIB-substituent is derived from a highly reactive PIB.

The PIB succinimide is as hereinbefore described. The concentrate may incorporate the PIB amine as hereinbefore described or it may be incorporated directly into the fuel. Similarly, the known additives may be incorporated either into the concentrate or into the fuel.

Suitable fuel-soluble carriers include, for example, oils, non-volatile poly(oxyalkylene)s, other synthetic lubricants or lubricating mineral oils. A preferred carrier oil is a poly(oxyalkylene) mono- or polyol.

Suitable fuel-soluble diluents include hydrocarbons, e.g. heptane, alcohols, eg methanol, ethanol or propanol, or ethers, eg methyl tert-butyl ether. Preferred diluents include aromatic hydrocarbons, such as toluene, xylenes, or their mixtures with alcohols or ethers.

The invention will now be further illustrated by reference to the following Examples.

EXAMPLES

PIBSA Preparation

Example A

A highly reactive polybutene ULTRAVIS (RTM) polybutene of $M_n$=990 ex BP Chemicals Limited) (200 g) was placed in a Parr autoclave together with powdered maleic anhydride (62 g). The autoclave was purged with nitrogen and sealed. The autoclave and its stirred contents were heated to 235° C. for 4 hours; the heating was stopped, the autoclave cooled and the contents placed in a Buchi rotary evaporator where unreacted maleic anhydride was removed under vacuum at 190° C. The remaining product was then filtered through diatomaceous earth.

Example B

Example A was repeated.

Example C

Example A was repeated except that instead of a polybutene of $M_n$990 there was used a highly reactive polybutene (an ULTRAVIS (RTM) polybutene of $M_n$=1200 ex BP Chemicals Limited).

Preparation of PIB succinimide

Example 1

The combined PIBSA product from Examples A and B (400 g) containing 20% of a mixed aromatic solvent was charged to a 1 liter flask fitted with a stirrer, Dean and Stark receiver and a dropping funnel. The flask contents were heated with stirring to 165° C. and tetraethylene pentamine (42.5 g) added dropwise from the dropping funnel over 15 to 20 minutes. The temperature of the flask contents was then allowed to rise to 175° C. over a period of 3 hours whilst water (2.3 ml) was removed via the Dean and Stark trap.

Comparison Test 1

Following the procedure of Example 1 a commercial sample of a PIBSA (made from a HYVIS polybutene of $M_n$=960 containing 70 ppm of chlorine and having less than 50% of the residual olefinic double bonds of the vinylidene type, i.e. not a highly reactive polybutene) containing 20% w/w of a mixed aromatic solvent was imidated by reaction with triethylene tetramine at 165° to 175° C. This is not an example according to the present invention because the PIB used to make the PIBSA is not a highly reactive PIB.

Fuel compositions

Example 2

The PIB succinimide/aromatic solvent product of Example 1 was included as a component of a proprietary commercially formulated gasoline detergent package. The package (500 ppm w/w) was blended in a 95 octane unleaded RF8A85 reference gasoline (base fuel).

Comparison Package 2

A gasoline detergent package was produced in the same manner as for Example 2 except that instead of the PIB succinimide product of Example 1 there was used the PIB succinimide product of Comparison Test 1.

Comparison Package 3

A gasoline detergent package was produced in the same manner as for Example 2 except that instead of the PIB succinimide product of Example 1 there was used a PIB amine.

Fuel Testing

Example 3

The gasoline of Example 2 was tested in an Opel Kadett engine. The manifold rating (on a scale 0–10 in which 10 represents clean) and the valve deposits (mg) were determined.

The results are given in the accompanying Table.

Comparison Test 3

Example 3 was repeated except that instead of using the gasoline of Example 2 there was used the gasoline of Comparison Package 2.

The results are given in the accompanying Table.

Comparison Test 4

Example 3 was repeated except that instead of using the gasoline of Example 2 there was used the gasoline of Comparison Package 3.

The results are given in the accompanying Table.

TABLE

| Example | Sample | Manifold rating (10 = clean) | Valve deposit (mg) |
|---|---|---|---|
| 3 | Package containing PIB succinimide of Ex. 1 | 10 | 116 |
| Comp. Test 3 | Package containing PIB succinimde of Comp. Test 1 | 10 | 229 |
| Comp. Test 4 | Package containing PIB amine | 8.5 | 98 |
| | Base fuel | 4.6 | 327 |

We claim:

1. A fuel composition comprising a major amount of a liquid hydrocarbon fuel and, in an amount to provide detergency, a polyisobutene succinimide derived from the reaction of a polyisobutene-substituted succinic acylating agent and an amine having at least one reactive hydrogen bonded to an amine nitrogen wherein the polyisobutene-substituted succinic acylating agent is obtained by a thermal route thus avoiding halogen contamination and the polyisobutene substituent is derived from a highly reactive polyisobutene having greater than 50% of the residual olefinic double bonds represented by the formula $—CH_2CMe{=}CH_2$.

2. A fuel composition according to claim 1 wherein the polyisobutene-substituted succinic acylating agent is obtained by the thermal reaction of a highly reactive polyisobutene and a succinic acylating agent of the formula:

$$R—CO—CH{=}CH—CO—R^1 \quad (I)$$

wherein R and $R^1$ are independently —OH, —O-hydrocarbyl or taken together are a single oxygen atom.

3. A fuel composition according to claim 2 wherein the succinic acylating agent is maleic anhydride and the resulting polyisobutene-substituted succinic acylating agent is polyisobutene succinic anhydride.

4. A fuel composition according to either claim 2 or claim 3 wherein the number average molecular weight of the polyisobutene is in the range from about 700 to about 5,000.

5. A fuel composition according to claim 2 or 3, wherein the amine from which the polyisobutene succinimide is derived has at least one primary amine group capable of reacting with the acylating agent.

6. A fuel composition according to claim 5 wherein the amine is a polyalkylene polyamine of the formula:

$$H_2N(R—NH)_nH \quad (II)$$

wherein R is a divalent aliphatic hydrocarbon group having 2 to 4 carbon atoms and n is an integer in the range 1 to 10.

7. A fuel composition according to claim 6 wherein the amine is a polyalkylene polyamine of the formula (II) wherein R is the group $—CH_2CH_2—$ and n has a value of 2 to 6.

8. A fuel composition according to claim 1, 2 or 3 further comprising a polyisobutene polyamine.

9. A fuel composition according to claim 8 wherein the polyisobutene moiety of the polyisobutene polyamine is derived from a highly reactive polyisobutene.

10. A fuel composition as claimed in claim 1, claim 2 or claim 3 wherein said highly reactive polyisobutene has greater than 70% of its residual olefinic double bonds represented by the formula —$CH_2CMe{=}CH_2$.

11. A fuel composition as defined in claim 1, wherein said amine is triethylene tetramine.

12. A concentrate composition suitable for use in a fuel composition wherein said concentrate comprises the polyisobutene succinimide of claim 1 and a fuel soluble carrier or a fuel soluble diluent.

13. A concentrate composition as defined in claim 12, wherein said highly reactive polyisobutene has greater than 70% of its residual olefinic double bonds represented by the formula —$CH_2CMe{=}CH_2$.

14. A concentrate composition as defined in claim 12, wherein said amine is triethylene tetramine.

* * * * *